US006367621B1

(12) United States Patent
Johnson

(10) Patent No.: US 6,367,621 B1
(45) Date of Patent: Apr. 9, 2002

(54) COMBINATION PLUNGER AND SCRUBBER HOLDER

(76) Inventor: Eddie Lee Johnson, 3201 Oliver Ave., North, Minneapolis, MN (US) 55412

( * ) Notice: Subject to any disclaimer, the term of this patent is extended or adjusted under 35 U.S.C. 154(b) by 0 days.

(21) Appl. No.: 09/631,484

(22) Filed: Aug. 3, 2000

Related U.S. Application Data

(60) Provisional application No. 60/147,160, filed on Aug. 4, 1999.

(51) Int. Cl.[7] ..... A45D 44/18

(52) U.S. Cl. ..... 206/15.3; 206/581; D11/143; 312/206

(58) Field of Search ..... 206/361, 362, 206/362.1, 362.2, 362.3, 15.2, 15.3, 349, 576, 581, 229, 823; 211/65; D6/551; D11/143, 146, 152; 312/206, 207, 326, 329, 229; 220/837, 839, 844

(56) References Cited

U.S. PATENT DOCUMENTS

| | | | | | |
|---|---|---|---|---|---|
| D151,762 | S | | 11/1948 | Karagozian | |
| D206,135 | S | | 11/1966 | O'Neil | |
| 3,429,474 | A | * | 2/1969 | Cann | 206/361 |
| 4,415,211 | A | | 11/1983 | Alissandratos | |
| 4,454,958 | A | * | 6/1984 | Juillet et al. | 206/380 |
| D291,039 | S | * | 7/1987 | Bokmiller | D32/25 |
| D292,631 | S | | 11/1987 | Tash | |
| 5,114,006 | A | * | 5/1992 | Wilk | 206/349 |
| 5,215,193 | A | * | 6/1993 | Dennis | 206/223 |
| 5,456,356 | A | | 10/1995 | Kurzawa | |
| 5,477,569 | A | * | 12/1995 | Porter | 4/483 |
| D370,376 | S | | 6/1996 | Mifsud | |
| 5,727,280 | A | * | 3/1998 | Romano | D6/551 |
| 5,924,566 | A | * | 7/1999 | Gibbs | 206/361 |
| 5,941,379 | A | * | 8/1999 | Barardo | 206/209 |
| D414,064 | S | * | 9/1999 | Shafik | D6/199 |
| 5,971,141 | A | * | 10/1999 | Shafik | 206/225 |
| 5,996,779 | A | * | 12/1999 | Klardie et al. | 206/63.5 |
| 6,202,837 | B1 | * | 3/2001 | Mason et al. | 206/209 |

* cited by examiner

*Primary Examiner*—Shian Luong

(57) ABSTRACT

A holder has a housing with two chambers for storing a cleaning brush and a water drain plunger. A cover hinged to the housing has an elongated slot with an open end accommodating upright handles of the brush and water drain plunger.

20 Claims, 6 Drawing Sheets

COMBINATION PLUNGER AND SCRUBBER HOLDER

This application claim benefit to provisional Ser. No. 60/147,160 filed Aug. 4, 1999

FIELD OF THE INVENTION

The invention is in art of containers for holding hand tools. The containers hold water closet cleaning and maintenance tools, such as a scrub brush and a water drain plunger, in upright storage positions.

BACKGROUND OF THE INVENTION

Household cleaning and maintenance hand tools are used to clean and dust fixtures, such as water closets having sinks, bathtubs and toilet bowels. These tools include brushes, sponges and water drain plungers. The brushes are normally stored in cabinets under sinks or in laundry rooms separated from the water closets. Small open top bowls are also used to accommodate toilet brushes. The bowls and brushes can be located adjacent the toilet bowels for convenience of the cleaning and maintenance persons. The small bowls do not accommodate water drain plungers. Water drain plungers are usually located in storage areas in garages, basements, closets and store rooms remote from locations where they are needed. A person must do considerable searching for a plunger when its use is required. In emergency situations water can over flow and cause costly water damage before the plunger is retrieved from its stored location. An object of the invention is to avoid the disadvantage of searching for a water drain plunger and cleaning brushes by using the holder of the invention to retain both the cleaning brush and water drain plunger.

SUMMARY OF THE INVENTION

The holder of the invention accommodates tools used to clean surfaces and fixtures, such as sinks, showers, floors and urinals, and toilet bowels. The tools are brushes, scrubbers and water drain plungers used in households and residential and commercial buildings to clean water closets and like rooms. The holder has an open top housing having a first compartment for storing the plunger and a second compartment for accommodating the brush. The open top of the housing is partly closed with a cover hinged to the housing. The cover has a top wall containing an elongated slot which allows the handles of the brush and plunger to be retained in upright positions.

The preferred embodiment of the holder has a housing having an upright cylindrical side wall joined to an upright generally U-shaped side wall. The side walls are joined to a stepped bottom wall. The cylindrical side wall has a diameter that is larger than the width of the U-shaped side wall. For example, the diameter of the cylindrical side wall may be twice the width of the U-shaped side wall. The side walls surround separate chambers or storage area for the cleaning brush and water drain plunger. The storage chamber for the plunger due to the stepped bottom wall has a depth greater than the depth of the chamber for accommodating the brush. A plurality of inwardly directed vertical ribs on the inside of the U-shaped side wall are used to stabilize and retain the brush in an upright position in its storage chamber. A bottom wall joined to the side walls has an anti-skid pad to keep the holder in place on a hard surface. The open top of the housing is partly closed with a cover hinged to a side wall which allows the cover to be moved upwardly to an open position whereby the brush and plunger can be removed from the holder. The cover has a top wall and a downwardly directed peripheral flange located adjacent the outside of upper portions of the side walls. An elongated slot along the middle of the top wall has an open end with an enlarged mouth. The upright handles of the brush and plunger extend upwardly through the slot. A live hinge or a pivot pin hinge connects one end of the cover to the housing. The housing including the ribs is a one-piece plastic member. The cover is an inverted pan-shaped plastic member hinged to the housing. The holder is a convenient and sanitary product for storing a cleaning brush and water drain plunger.

DESCRIPTION OF EMBODIMENTS OF THE HOLDER

Figure 1:
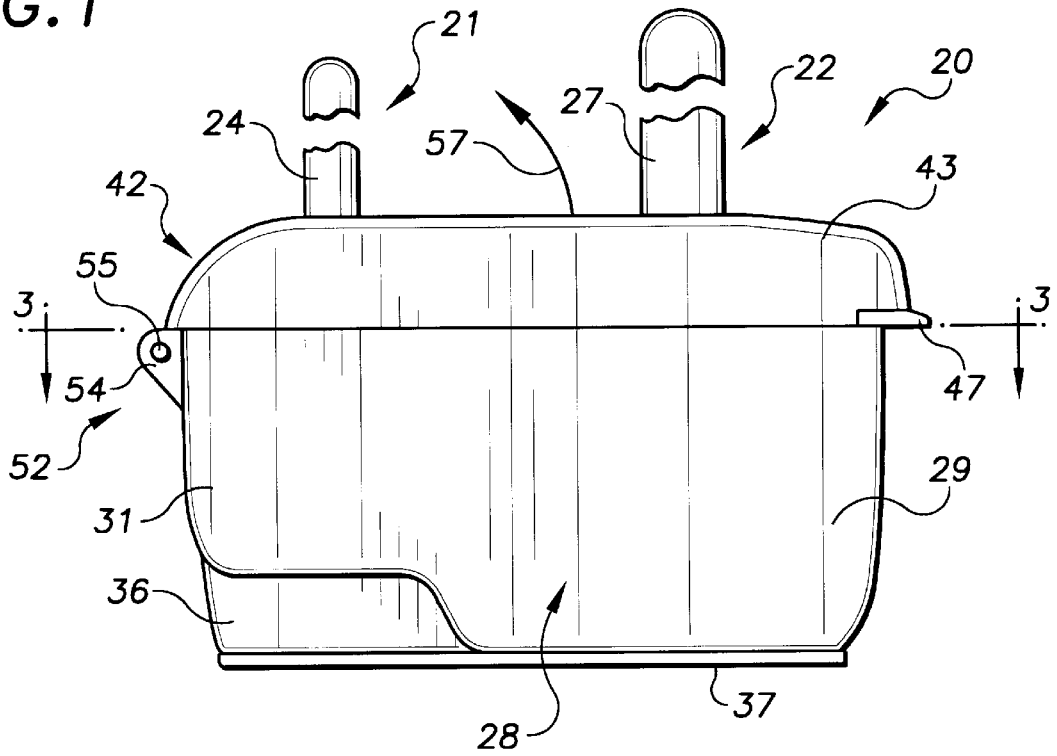
FIG. 1 is a side elevational view of the cleaning brush and water drain plunger holder of the invention.
Figure 2:
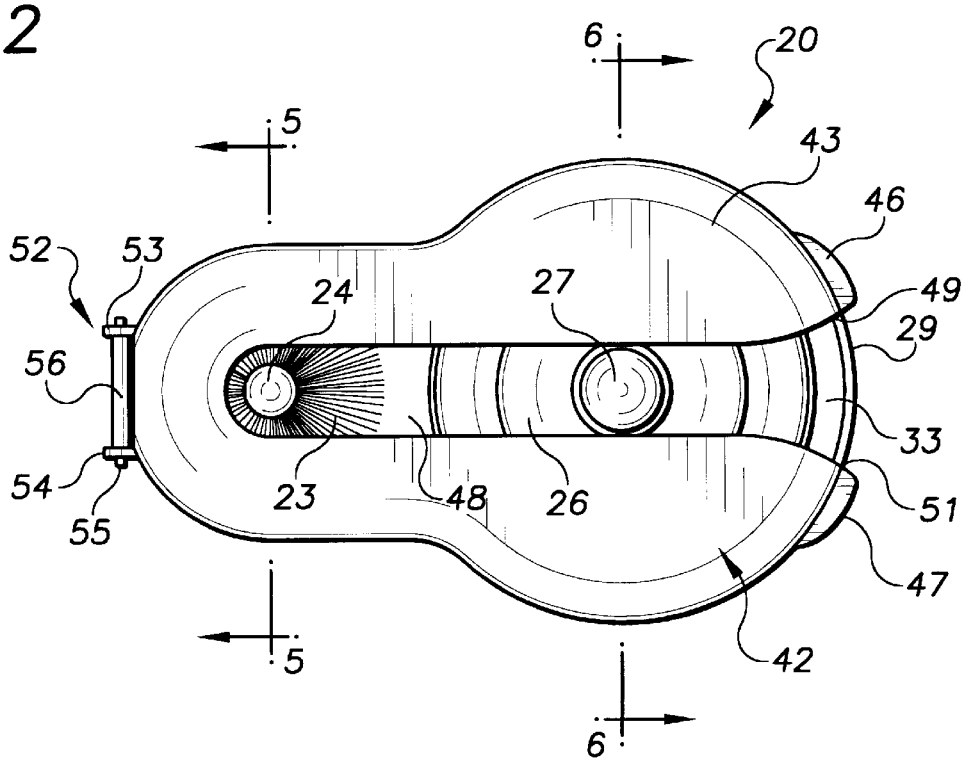
FIG. 2 is a top plan view thereof.
Figure 5:
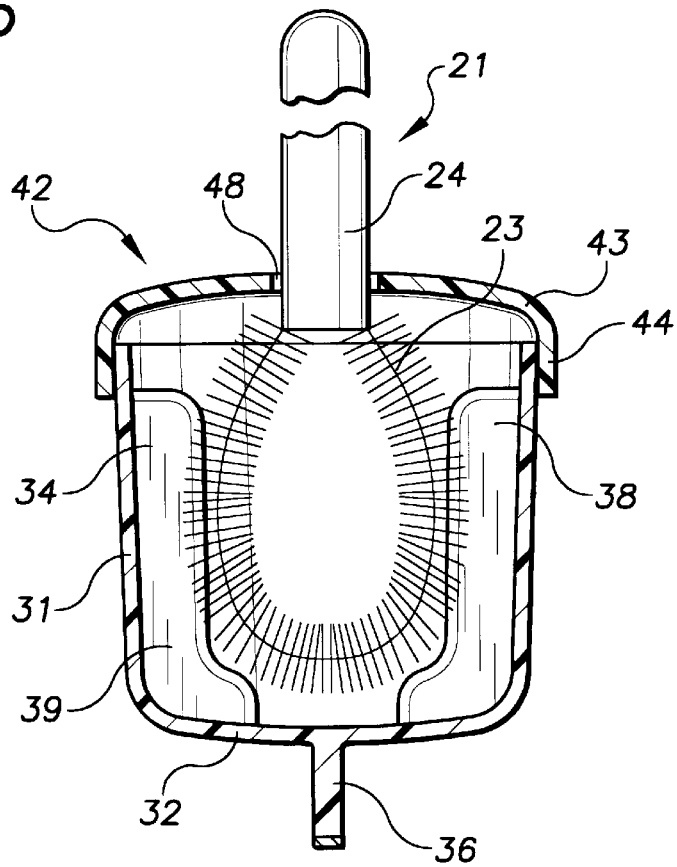
FIG. 5 is a sectional view taken along the line 5—5 of FIG. 2.

The holder 20, shown in FIGS. 1 and 2, is a dwelling and shelter for cleaning tools used to clean surfaces and fixtures. Holder 20 accommodates a conventional brush 21 and a water drain plunger 22 used in water closets to scrub surfaces, sinks, bathtubs, showers, floors, urinals and toilet bowels. Plunger 22 is used to unplug water drains. As shown in FIG. 5, brush 21 is a scrubber having fibers 23 attached to an elongated linear handle 24. Other types of brushes can be stored in holder 20. Plunger 22, shown in FIG. 6, has a flexible cone-shaped member or bowel 26 attached to an elongated linear handle 27. An alternative plunger has a spherical bowel connected to a handle. Holder 20 conveniently stores brush 21 and plunger 22 in a location, such as a water closet, a bathroom, or a laundry room, where these tools are used. Plunger 22 is available without time consuming searching in closets and other locations. In emergency situations a readily available plunger can prevent costly water damage due to over flow of sinks, bathtubs, showers, and toilet bowels.

Holder 20 has an open top housing 28 comprising an upright semi-cylindrical side wall 29 joined to an upright U-shaped side wall 31. Walls 29 and 31 have a small upwardly and outwardly taper or draft. Walls 29 and 31 are joined to a stepped bottom wall 32. Walls 29 and 31 have relatively large outside surfaces which can accommodate surface decorations, visual art work and one or more trademarks and tradenames. Wall 29 surrounds a first compartment or chamber 33 having a size to accommodate the bowel 26 of plunger 22. A second compartment or chamber 34 open to chamber 33 and surrounded by U-shaped wall 31 accommodates brush 21, as shown in FIG. 5. The stepped bottom wall 32 of chamber 34 is at a higher elevation than the bottom wall 32 of chamber 33. The outer end of wall 29 can have an angle shape to allow holder 20 to fit into a corner of a room or zimmer. The diameter or lateral dimension of wall 29 is greater than the width of wall 31. In the preferred embodiment of holder 20, the diameter of wall 29 is twice the width of wall 32.

Figure 3:
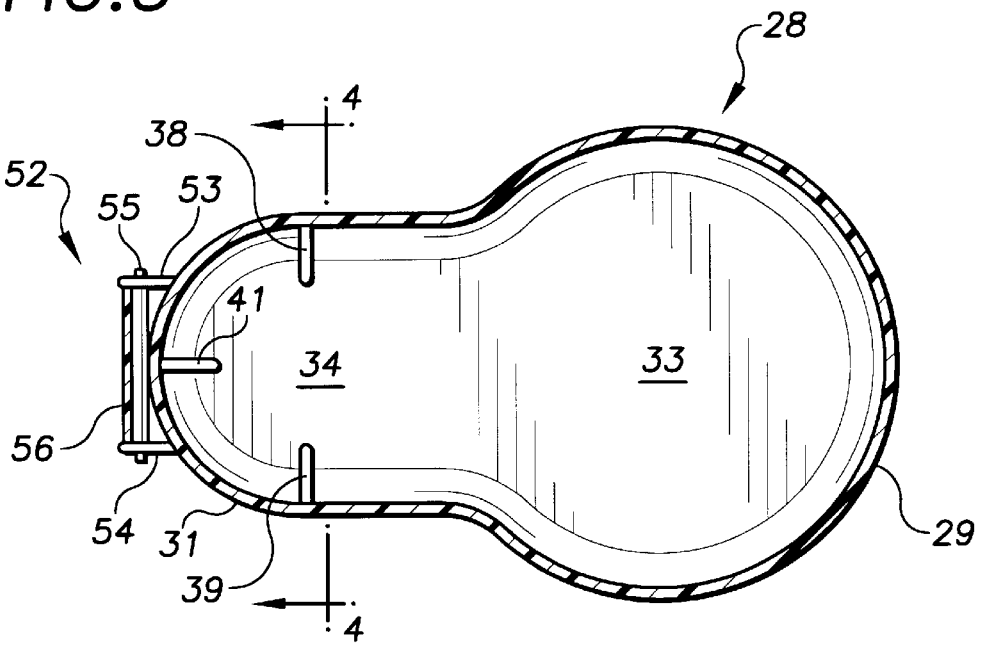
FIG. 3 is a sectional view taken along the line 3—3 of FIG. 1 without the brush and plunger.

As shown in FIGS. 1, 3 and 5, a linear rib 36 extends downward from the bottom wall 32 under chamber 34. Rib 36 has a bottom surface aligned with the bottom wall 32 under chamber 33 whereby housing 28 is horizontally supported on a floor. A flat anti-skid rubber-like pad 37 secured with an adhesive to bottom wall 32 and rib 36 grips a support surface to prevent sliding of the holder on a hard surface. Circular rubber-like disks can be secured to bottom wall 32 in lieu of pad 37.

Figure 4:
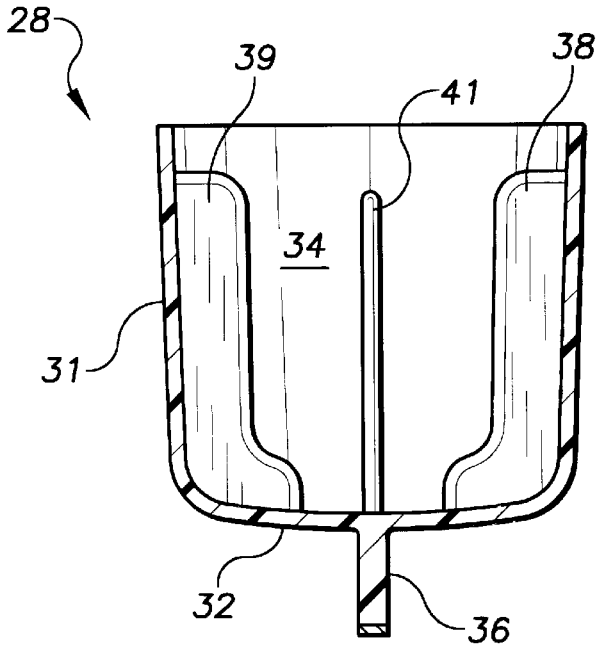
FIG. 4 is a sectional view taken along the line 4—4 of FIG. 3.
Figure 6:
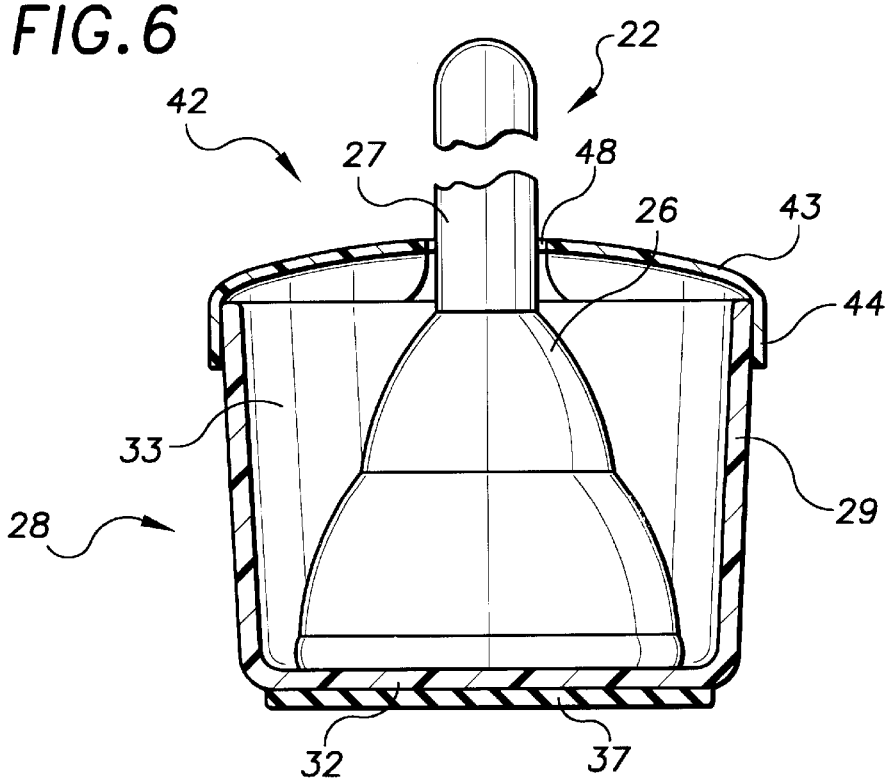
FIG. 6 is a sectional view taken along the line 6—6 of FIG. 2.

As shown in FIGS. 3 and 4, a pair of upright transverse ribs 38 and 39 joined to the inside of wall 31 project into chamber 34. An upright longitudinal rib 41 joined to the end of wall 31 projects into chamber 34. As shown in FIG. 5, fibers 23 of brush 21 cooperate with ribs 38, 39 and 41 to retain brush 21 in an upright position. Plunger bowel 26 has a flat bottom that rests on bottom wall 32, as shown in FIG. 6.

The entire housing 28 including ribs 38, 39 and 41 is a one-piece rigid plastic member. A suitable plastic is rigid polyethylene. Other types of plastics and materials, such as ceramics or clay, can be used for housing 28. The plastic for housing 28 can be vacuum or injection molded.

The open top of housing 28 is partly closed with a cover 42 having a top wall 43 and a peripheral flange 44. The entire cover 42 is a one-piece rigid plastic member. The plastic is polyethylene. Other types of plastics and materials can be used for cover 42. As seen in FIGS. 5 and 6, flange 44 extends downwardly adjacent the outside of the top of the side walls 29 and 31 of housing 28. Cover 42, when in the closed position, rests on top of side walls 29 and 31. Cover 42 has an inverted pan shape with a large generally circular end and a U-shaped end complimentary to the shape of side walls 29 and 31 of housing 28. Top wall 43, as seen in FIG. 2, has a large outside surface. Visual art work, trademarks and designs can be placed on the top wall 43 to enhance its ornamentation. Returning to FIGS. 1 and 2, the large end of cover 42 has a pair of outwardly directed lips 46 and 47. In use, lips 46 and 47 are finger grips used by a person to raise cover 42 to an open position. The longitudinal center of top wall 43 has a linear slot or opening 48 having a uniform width to accommodate handles 24 and 27. The open end of slot 48 has a mouth located between outwardly directed convex curved edges 49 and 51 of top wall 43. In use, when cover 42 is moved from the open position to the closed position, convex edges 49 and 51 guide handles 24 and 27 into slot 48. The U-shaped end of cover 42 closes the end of slot 48. A transverse hinge 52 pivotally connects the U-shaped end of cover 42 to the end of side wall 31 to allow cover 42 to pivot, as shown by arrow 57, between a down closed position and an up open position. When cover 42 is in the open position the brush and plunger can be readily removed from holder 20. Hinge 52 comprises a pair of laterally spaced brackets 53 and 54 secured to the end of wall 31 and a pivot member 56 secured to the cover adjacent brackets 53 and 54. A pivot pin or rod 55 pivotally connects member 56 to brackets 53 and 54 to allow cover 42 to pivot about the transverse axis of pin 55. Other types of hinges can be used to pivotally connect the cover 42 to housing 28. A live hinge, as shown in FIG. 7, can join cover 42 to housing 28.

A modification of the holder, indicated generally at 120 of the invention is shown in FIGS. 7 to 12. The parts of holder 120 that correspond to parts of holder 20 have the same reference number with the prefix 1.

Figure 7:
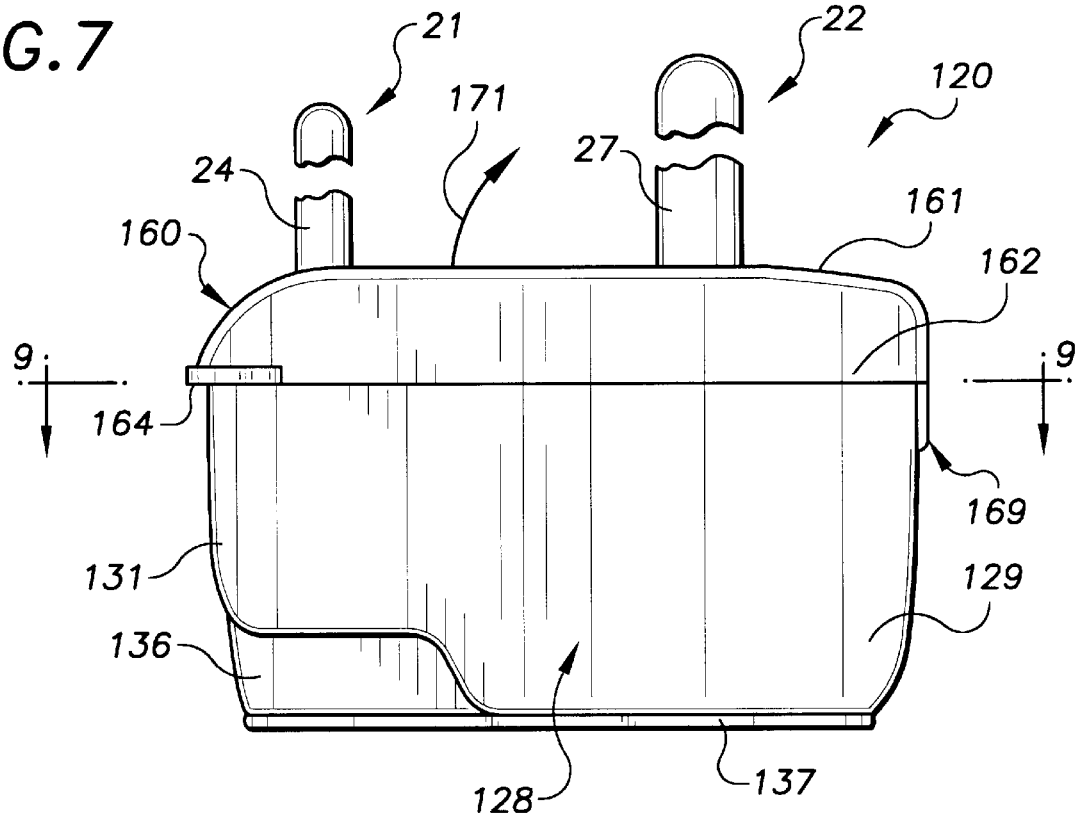
FIG. 7 is a side elevational view of a modification of the cleaning brush and water drain plunger holder of the invention.
Figure 8:
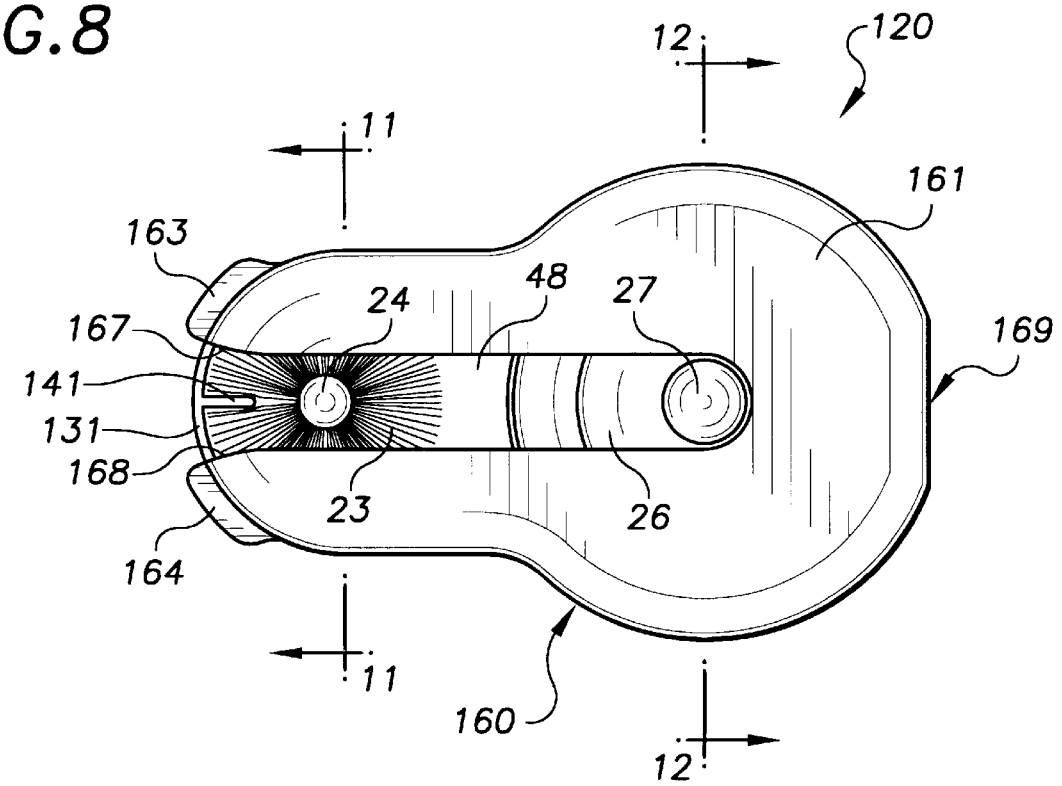
FIG. 8 is a top plan view of FIG. 7.
Figure 11:
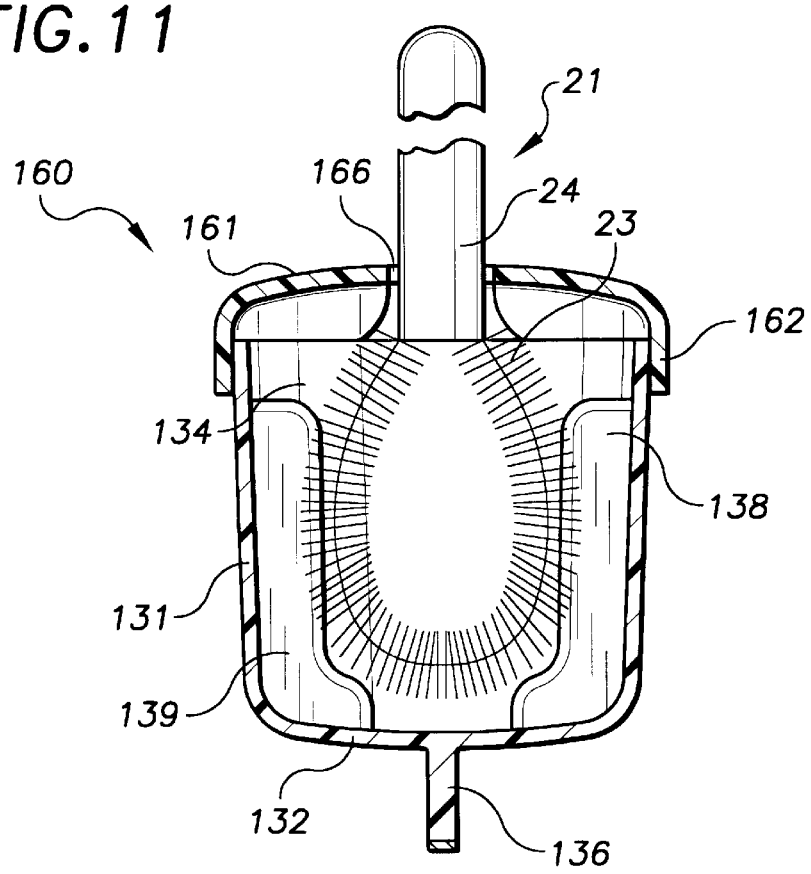
FIG. 11 is a sectional view taken along the line 11—11 of FIG. 8.

Holder 120, shown in FIGS. 7 and 8, is a dwelling and shelter for cleaning tools used to clean surfaces and fixtures. Holder 120 accommodates a conventional brush 21 and a water drain plunger 22 used in water closets to scrub surfaces, sinks, bathtubs, showers, floors, urinals and toilet bowels. Plunger 22 is used to unplug water drains. As shown in FIG. 11, brush 21 is a scrubber having fibers 23 attached to an elongated linear handle 24. Other types of brushes can be stored in holder 120. Plunger 22, shown in FIG. 12, has a flexible cone-shaped member or bowel 26 attached to an elongated linear handle 27. An alternative plunger has a spherical bowel connected to a handle. Holder 120 conveniently stores brush 21 and plunger 22 in a location, such as a water closet, a bathroom, or a laundry room, where these tools are used. Plunger 22 is available without time consuming searching in closets and other locations. In emergency situations a readily available plunger can prevent costly water damage due to over flow of sinks, bathtubs, showers, and toilet bowels.

Holder 120 has an open top housing 128 comprising an upright semi-cylindrical side wall 129 joined to an upright U-shaped side wall 131. Walls 129 and 131 are joined to a bottom wall 132. Wall 129 surrounds a first compartment or chamber 133 having a size to accommodate the bowel 26 of plunger 22. A second compartment or chamber 134 open to chamber 133 and surrounded by U-shaped wall 131 accommodates brush 21, as shown in FIG. 11.

Figure 10:
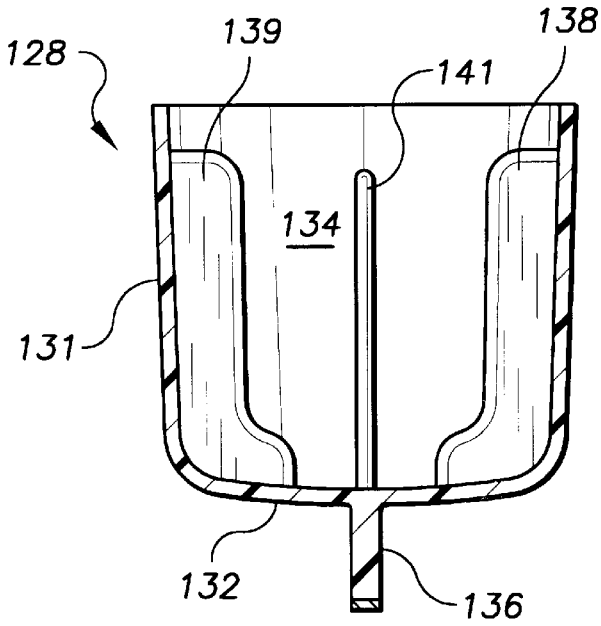
FIG. 10 is a sectional view taken along the line 10—10 of FIG. 9.

As shown in FIGS. 7, 10 and 11, a linear rib 136 extends downward from the bottom wall 132 under chamber 134. Rib 136 has a bottom surface aligned with the bottom wall 132 under chamber 133 whereby housing 128 is horizontally supported on a floor. A flat anti-skid rubber-like pad 137 secured with an adhesive to bottom wall 132 and rib 136 grips a support surface to prevent sliding of the holder on a hard surface. Circular rubber-like disks can be secured to bottom wall 132 in lieu of pad 137.

Figure 9:
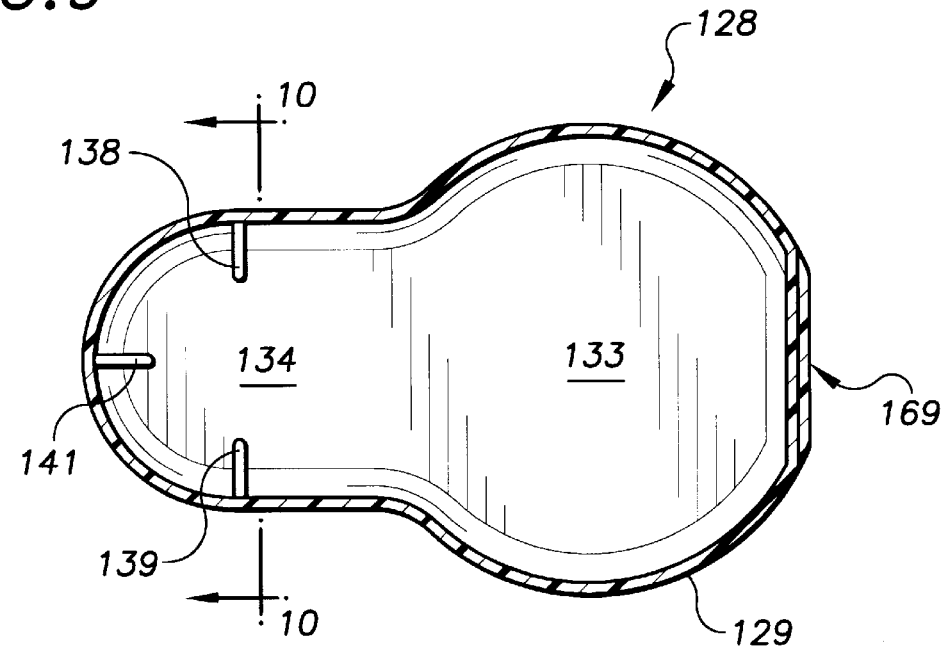
FIG. 9 is a sectional view taken along the line 9—9 of FIG. 7 without the brush and plunger.
Figure 12:
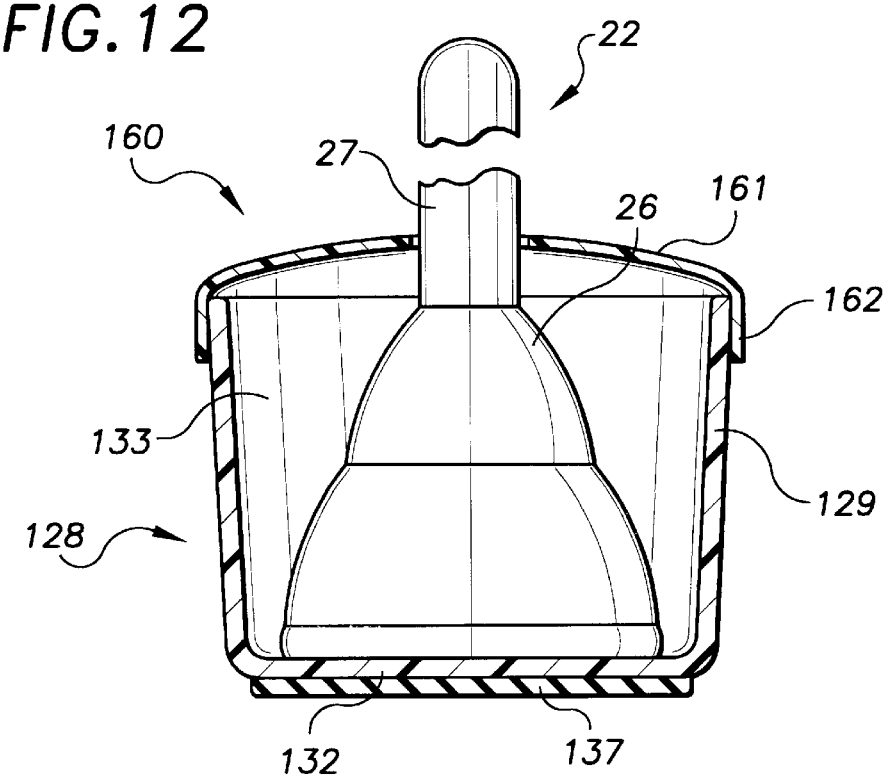
FIG. 12 is a sectional view taken along the line 12—12 of FIG. 8.

As shown in FIGS. 9 and 10, a pair of upright transverse ribs 138 and 139 joined to the inside of wall 131 project into chamber 134. An upright longitudinal rib 141 joined to the end of wall 131 projects into chamber 134. As shown in FIG. 11, fibers 23 of brush 21 cooperate with ribs 138, 139 and 141 to retain brush 21 in an upright position. Plunger bowel 26 has a flat bottom that rests on bottom wall 132, as shown in FIG. 12.

The open top of housing 128 is partly closed with a cover 160 having a top wall 161 and a peripheral flange 162. As seen in FIGS. 11 and 12, flange 162 extends downwardly adjacent the outside of the top of the side walls 129 and 131 of housing 128. Cover 160, when in the closed position, rests on top of side walls 129 and 131. Cover 160 has an inverted pan shape with a large generally circular end and a U-shaped end complimentary to the shape of side walls 129 and 131 of housing 128. Returning to FIGS. 7 and 8, the small end of cover 160 has a pair of outwardly directed lips 163 and 164. In use, lips 163 and 164 are finger grips used by a person to raise cover 160 to an open position. The longitudinal center of top wall 161 has a linear slot or opening 166 having a uniform width to accommodate handles 24 and 27. The open end of slot 166 has a mouth located between convex curved edges 167 and 168 of top wall 161. In use, when cover 160 is moved from the open position to the closed position, convex edges 167 and 168 guide handles 24 and 27 into slot 166. The large end of cover 160 closes the end of slot 166. A transverse live hinge 169 pivotally connects the large end of cover 166 to the end of side wall 129 to allow cover 160 to swing or pivot, as shown by arrow 171, between a down closed position and an up open position. Hinge 169 comprises a strip of flexible material, such as plastic joined to side wall 129 and flange 162 or cover 160. The strip of flexible material allows cover 160 to be moved between its open and closed positions. Other types of hinges can be used to pivotally connect the cover 160 to housing 128.

A sanitizer and deodorizer can be placed in one or both of the chambers 33, 133 and 34, 134 to control odors and bacteria. The deodorizer can be a sponge unit accommodating a disinfectant which can be refilled or periodically replaced. A foot operated mechanism can also be operatively connected to the cover to allow a person's foot to open the cover so that the brush and plunger can be removed from the holder.

While there has been shown and described preferred embodiments of the holder for cleaning tools of the invention, it is understood that changes in structure, materials, arrangement of structures and materials may be made by a person skilled in the art without departing from the invention. The invention is defined in the following claims.

I claim:

1. A holder for a brush having an elongated handle and a water drain plunger having a flexible bowel-shaped member and elongated handle comprising: an open top housing having a first upright side wall, a second upright side wall and a bottom wall joined to the first and second side walls, said first and second side walls and bottom wall surrounding first and second chambers for accommodating a water drain plunger and a brush, a cover movable to open and closed positions relative to the open top of the housing, said cover having a first end and a second end opposite the first end, an elongated opening extended between said first and second ends of the cover adapted to accommodate the handles of the water drain plunger and brush located in said chambers, said elongated opening having an open end at the first end of the cover and a closed end spaced from the second end of the cover, and hinge means pivotally connecting the second end of the cover to one side wall whereby the cover can be moved from the closed position to the open position to permit the water drain plunger and brush to be removed from the housing and placed back into the chambers of the housing.

2. The holder of claim 1 wherein: the hinge means includes a first member secured to said one side wall, a second member secured to the second end of the cover, a horizontal pivot means connecting the first and second members whereby the cover pivots about a horizontal axis between the open and closed positions of the cover.

3. The holder of claim 1 wherein: the hinge means is a flexible member providing a live hinge joined to said one side wall and the second end of the cover whereby the cover can be moved between the open and closed positions of the cover.

4. The holder of claim 1 wherein: the opening in the cover is an elongated generally U-shaped opening.

5. The holder of claim 1 wherein: the first chamber partly surrounded by the first side wall has a lateral dimension greater than the lateral dimension of the second chamber partly surrounded by the second side wall.

6. The holder of claim 5 wherein: the lateral dimension of the first chamber is about twice the lateral dimension of the second chamber.

7. The holder of claim 1 wherein: the cover has a top wall and a peripheral downwardly extended flange, said flange being located adjacent outside upper portions of the first and second side walls when the cover is in its closed position.

8. The holder of claim 1 wherein: the hinge means is secured to the first side wall and the second end of the cover.

9. The holder of claim 1 wherein: the cover has a top wall having said elongated opening, said top wall having laterally spaced outwardly curved edges adjacent the open end of the elongated opening.

10. The holder of claim 1 wherein: the hinge means is a live hinge connecting the first side wall to the second end of the cover.

11. The holder of claim 1 wherein: the hinge means is secured to the second side wall and second end of the cover.

12. The holder of claim 1 including: anti-skid means secured to at least a portion of the bottom wall for inhibiting sliding of the holder on a surface.

13. A holder for a brush having an elongated handle and a water drain plunger having a bowel shaped member and an elongated handle comprising: an open top housing having a generally partial cylindrical upright wall and a U-shaped upright wall joined to the cylindrical wall, a stepped bottom wall joined to the upright walls, said partial cylindrical upright wall and bottom wall surrounding a first chamber for accommodating the bowel shaped member of the plunger, said U-shaped upright wall and bottom wall surrounding a second chamber for accommodating the brush, said first chamber being larger than the second chamber, means on the U-shaped upright wall for retaining the brush in an upright position with the handle of the brush extended upwardly, a cover for partly closing the open top of the housing, said cover having a top wall with a linear slot adapted to accommodate said handles of the brush and plunger, said cover having a first end and a second end opposite the first end, said slot having an open end at the first end of the cover and a closed end spaced from the second end of the cover, and hinge means pivotally connecting the second end of the cover to one side wall whereby the cover can be moved from the closed position to the open position to permit the plunger and brush to be removed from the housing and placed back into the first and second chambers.

14. The holder of claim 13 wherein: the means on the U-shaped upright wall for retaining the brush in an upright position comprises at least one inwardly and upwardly extended rib adapted to engage the brush.

15. The holder of claim 13 wherein: the cover has a downwardly directed flange joined to the top wall, said flange being located adjacent upper portions of the first and second side walls when the cover is closed.

16. The holder of claim 13 wherein: the opening in the cover is an elongated generally U-shaped opening.

17. The holder of claim 16 wherein: said top wall has laterally spaced outwardly curved edges adjacent the open end of the slot.

18. The holder of claim 13 wherein: the hinge means is a live hinge connecting the first side wall to the second end of the cover.

19. The holder of claim 13 including: anti-skid means secured to the bottom of the bottom wall for inhibiting sliding of the holder on a surface.

20. A holder for a brush having an elongated handle and a water drain plunger having a bowel shaped member and an elongated handle comprising: an open top housing having a generally partial cylindrical upright wall and a U-shaped upright wall joined to the cylindrical wall, a stepped bottom wall joined to the upright walls, said partial cylindrical upright wall and bottom wall surrounding a first chamber for accommodating the bowel shaped member of the plunger, said U-shaped upright wall and bottom wall surrounding a second chamber for accommodating the brush, said first chamber being larger than the second chamber, a plurality of upright ribs on the U-shaped upright wall for retaining the brush in an upright position with the handle of the brush extended upwardly, a cover for partly closing the open top of the housing, said cover having a top wall with a linear U-shaped slot adapted to accommodate said handles of the brush and plunger, said cover having a first end and a second end opposite the first end, said slot having an open end at the first end of the cover and a closed end spaced from the second end of the cover, said cover having a downwardly directed flange joined to the top wall, said flange being located adjacent upper portions of the first and second side walls of the housing when the cover is in the closed position, hinge means pivotally connecting the second end of the cover to one side wall whereby the cover can be moved from the closed position to the open position to permit the plunger and brush to be removed from the housing and placed back into the first and second chambers, and antiskid means secured to a bottom portion of the bottom wall for inhibiting sliding of the holder on a surface.

* * * * *